US008611572B2

(12) United States Patent
Puder

(10) Patent No.: US 8,611,572 B2
(45) Date of Patent: Dec. 17, 2013

(54) DEVICE AND METHOD FOR CONTROLLING THE STEP SIZE OF AN ADAPTIVE FILTER

(75) Inventor: Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1707 days.

(21) Appl. No.: 11/821,958

(22) Filed: Jun. 26, 2007

(65) Prior Publication Data

US 2007/0297627 A1 Dec. 27, 2007

(30) Foreign Application Priority Data

Jun. 26, 2006 (DE) ..... 10 2006 029 194

(51) Int. Cl.
*H04R 25/00* (2006.01)

(52) U.S. Cl.
USPC ..... 381/318; 381/317

(58) Field of Classification Search
USPC ..... 381/318, 93, 312, 317, 320, 71.11, 83, 381/94.1
See application file for complete search history.

(56) References Cited

U.S. PATENT DOCUMENTS 7,340,063 B1 * 3/2008 Nielsen et al. ..... 381/71.11
2006/0093173 A1 5/2006 Hamacher et al.

FOREIGN PATENT DOCUMENTS

DE 19904528 C1 7/2000
DE 10 2004 050 304 B3 6/2006
EP 0 824 845 B1 2/1998

OTHER PUBLICATIONS

Hsiang-Feng Chi, Shawn X. Gao, Sigfrid D. Soli, Abeer Alwan, "Band-limited feedback cancellation with a modified filtered-X LMS algorithm for hearing aids", Speech Communications, 2003, pp. 147-161, vol. 39, XP-002295470, Elsevier.

* cited by examiner

*Primary Examiner* — Brian Ensey

(57) ABSTRACT

The determination of a suitable step size for controlling the adaptation of a filter of an acoustic feedback compensator especially for hearing aids is to be improved. A step size controller is therefore provided in which an input signal is analyzed in at least two frequency bands. In doing so, any steep signal edges in the individual frequency bands are detected. The adaptation step size of an adaptive filter is then controlled depending on the number of frequency bands in which steep signal edges are detected, wherein the magnitude of the signal edges can be included in the decision.

11 Claims, 2 Drawing Sheets

DEVICE AND METHOD FOR CONTROLLING THE STEP SIZE OF AN ADAPTIVE FILTER

CROSS REFERENCE TO RELATED APPLICATIONS

This application claims priority of German application No. 10 2006 029 194.8 filed Jun. 26, 2006, which is incorporated by reference herein in its entirety.

FIELD OF THE INVENTION

The present invention relates to a device for controlling the step size of an adaptive filter for suppressing acoustic feedback. In addition, the invention relates to a corresponding method for controlling the step size. In particular, the control of step size refers to adaptive filters of hearing devices, such as hearing aids for example

BACKGROUND OF THE INVENTION

Feedback in hearing aids is often compensated for by adaptive filters. In doing so, the filter is appropriately adapted to suit the feedback situation. The adaptation is carried out in steps. The problem here is that in many situations a rapid adaptation of the filter is desired and in other situations a rather slower adaptation of the filter is desired. Accordingly, a suitable step size must be found for the adaptation.

Previously, this problem has been solved, for example, by shadow filter methods, methods for amplitude or phase modulation of the output signals and so on. However, most of these approaches have considerable weaknesses, in particular when it comes to differentiating strongly correlated excitation signals such as music, the clinking of glass or cutlery, for example, from feedback(s) or feedback signal(s). With strongly correlated excitation signals, the step size should namely be reduced in order to prevent an incorrect adaptation of the filter and therefore signal distortion due to resulting feedback. With less correlated signals, e.g. in the case of white noise, the step size should be rapidly increased in order to terminate the feedback resulting from a changed acoustic environment as quickly as possible, e.g. a hand in the vicinity of the hearing aid.

A method for controlling a hearing aid for adjusting the adaptation in situ is disclosed in patent specification EP 0 824 845 B1. If noticeable feedback is ascertained when operating the hearing aid, the maximum gain is reduced for at least one of several frequency bands. The gain in all other frequency bands remains unchanged so that the transmission function is to be adapted for at least one frequency band.

Furthermore, a method for reducing feedback in an acoustic system is described in patent specification DE 10 2004 050 304 B3. Here, an output signal and therefore also a feedback signal is modulated so that the feedback signal can be detected. The information relating to the presence of feedback can be used for controlling the step size of an adaptive compensation filter. A filter of this kind can be used for partial bands and also for the complete band.

SUMMARY OF THE INVENTION

The object of the present invention consists in better adapting the compensation of feedback to the current acoustic situations.

According to the invention, this object is achieved by a device that controls the step size for an adaptive filter for suppressing acoustic feedback by having an analyzing unit for analyzing an input signal in at least two frequency bands, the analyzing unit by having an edge detection unit with which steep signal edges can be detected in the individual frequency bands, the rate of rise of which edges has or exceeds a predetermined rate, and a control unit being connected to the analyzing unit, with which control unit the adaptation step size of the adaptive filter can be controlled depending on the number of frequency bands in which steep signal edges are detected by the analyzing unit. In doing so, the magnitude of the signal edges can also be taken into account.

Furthermore, according to the invention, a method is provided for controlling the step size for an adaptive filter for suppressing acoustic feedback by analyzing an input signal in at least two frequency bands, steep signal edges being detected in the individual frequency bands, the rate of rise of which edges has or exceeds a predetermined rate, and the adaptation step size of the adaptive filter being controlled depending on the number of frequency bands in which steep signal edges are detected.

In doing so, the magnitude of the signal edges can also be taken into account.

The present invention is based on the idea that, when the feedback condition is fulfilled, feedback signals occur very quickly and have an extremely narrow bandwidth. In contrast with this, natural signals are only very rarely monofrequent. The tones of musical instruments, for example, therefore have several harmonics, whereby the criterion of narrow bandwidth described above is not fulfilled. In an advantageous manner, this signal difference is now utilized to control the step size of an adaptive filter for compensating for feedback.

Preferably, the step size is only increased by the control unit, which is connected to the analyzing unit of the step size control device according to the invention, when steep signal edges are detected in a maximum of two frequency bands. If, namely, the feedback signal lies exactly at the cut-off frequency of the band pass filter for assigning the signals to frequency bands, both of these bands may be affected in the event of feedback. The control is therefore carried out depending on a detection in a maximum of two bands.

In a preferred embodiment, the step size controller increases the step size very quickly compared to the subsequent reduction, and reduces it within 0.5 to 1 second. As a result, feedback signals only occur for a very short time.

The step size can be reduced to a predetermined average value, for example an average standard step size. As a result of this, the system automatically returns to an average adaptation mode after the steep signal edges have been detected.

If steep signal edges are detected in more than two frequency bands, it is advantageous to have the control unit reduce the step size for the adaptation of the filter. From experience, there is namely no feedback when steep signal edges occur in several frequency bands, or this is not the reason for the steep signal edges, so that adaptation can be carried out more slowly. Here too, it is advantageous that the control unit reduces the step size very quickly compared with the subsequent increase, and increases it again within 0.5 to 1 second.

According to a simpler variant of the step size control device according to the invention, the adaptive filter is adapted with only two step sizes, and accordingly the control unit produces binary control signals. In this way, the idea according to the invention can be realized cost-effectively.

Particularly advantageously, the step size control device according to the invention can be used in a hearing device and in particular in a hearing aid. The invention can also be used for other hearing devices, however, such as headsets, headphones and the like.

BRIEF DESCRIPTION OF THE DRAWINGS

The present invention is now explained in more detail with reference to the attached drawings, in which.

DETAILED DESCRIPTION OF THE INVENTION

The exemplary embodiment described in more detail below represents a preferred embodiment of the present invention.

Figure 1:
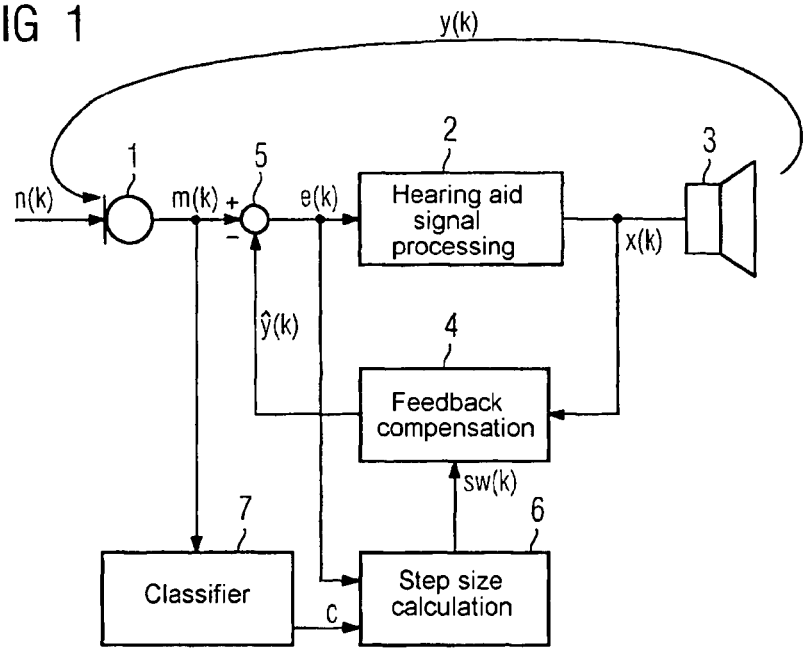
FIG. 1 shows a block circuit diagram of a hearing aid with feedback.

FIG. 1 shows a hearing aid circuit with a microphone 1, a signal processor 2 and a listening device 3. The signal x(k) emanating from the signal processor 2 is fed back from the listening device 3 to the microphone 1 as signal y(k), where k represents a discrete time index. As well as the feedback signal y(k), the microphone 1 also picks up a useful signal n and outputs a microphone signal m. A feedback compensator 4 picks up the output signal x(k) of the hearing aid signal processor 2 and from this generates an estimated feedback signal $\hat{y}(k)$. This estimated feedback signal $\hat{y}(k)$ is subtracted from the useful signal in a subtractor 5, which is located between the microphone 1 and the hearing aid signal processor 2, so that a resulting signal e(k) is produced, which is fed into the hearing aid signal processor 2.

According to the invention, the signal e(k) is analyzed in a step size calculation unit 6 with regard to steep edges. As a further input signal, the step size calculation unit 6 receives a classifier signal c of a classifier 7, which for its part receives the microphone signal m(k) of the microphone 1 as an input signal. From the classifier signal c and the signal e(k), which has been rid of feedback, the step size calculation unit 6 determines a step size for adapting an adaptive filter in the feedback compensation unit 4. An appropriate step size signal is therefore passed on from the step size calculation unit 6 to the feedback compensation unit 4.

Figure 2:
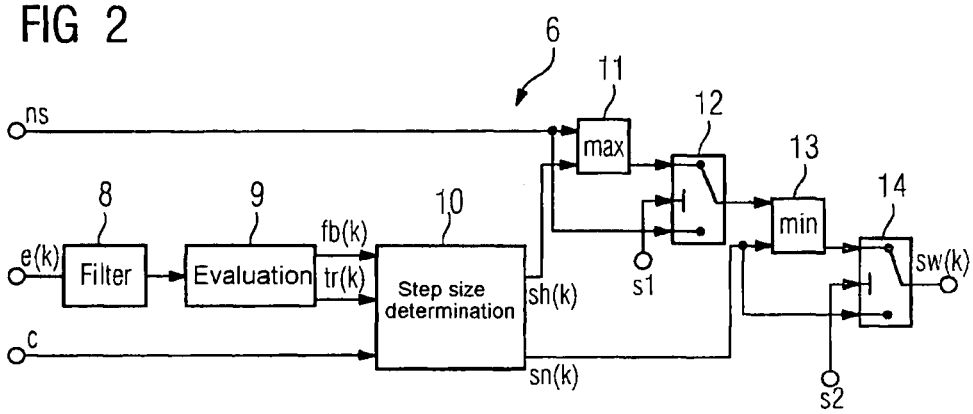
FIG. 2 shows a detailed circuit diagram of a device for calculating the step size.

The step size calculation unit 6 is shown in detail in FIG. 2. The signal e(k), which has been rid of feedback, i.e. the signal after the feedback subtraction, is fed to a filter 8. Here, the signal is broken down into appropriate frequency bands. For simplicity, however, only one output signal to the next evaluation unit 9 is shown in FIG. 2. Here, the respective band is examined for steep signal edges. Depending on this, the evaluation unit 9 decides whether feedback, i.e. a feedback signal, or a transient sound is present. Accordingly, a binary feedback signal fb(k) is output, which is "1" in the case of a feedback and "0" otherwise. Likewise, the evaluation unit 9 outputs a binary transient signal tr, which is 1 when a transient signal is present and is 0 otherwise. These two binary signals fb(k) and tr(k) are fed to a step size determination unit 10. Furthermore, the classifier signal c is also input to this unit.

Figure 3:
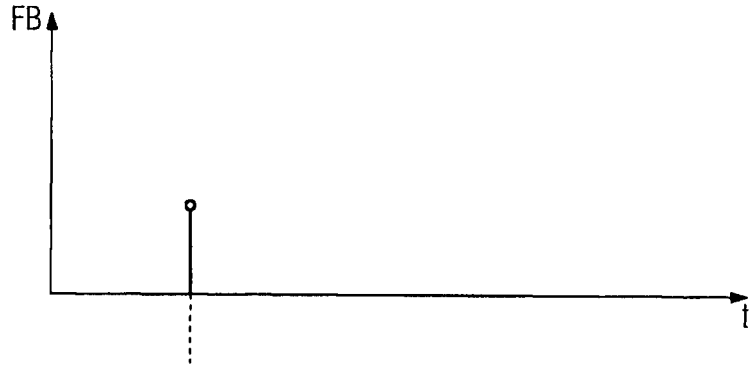
FIG. 3 shows a time diagram for the occurrence of feedback.

If now, for example, a feedback signal is detected at the time t1 as shown in FIG. 3, then a signal sh(k) is output with which the step size is to be increased. For this purpose, the signal sh(k) is compared with a standard step size ns in a comparator 11. A subsequent switch 12 allows a decision to be made as to whether the maximum signal of ns and sh(k) or the signal ns is passed on directly. For this purpose, the switch 12 is driven by an appropriate switching signal s1. The characteristic shown in FIG. 5 then results as the step size output signal sw(k) from the time t1. The step size at time t1 is first increased abruptly and is then again reduced gradually to the standard step size ns.

If, on the other hand, transient sound is detected by means of the evaluation unit 9, then the step size must be reduced, for which reason an appropriate signal sn is output from the step size determination unit 10 and fed to a second comparator 13. If necessary, this second comparator also receives the standard step size ns as an input signal and outputs the minimum of the two values. A subsequent switch unit 14 enables the output signal of the second comparator 13 or the signal sn of the step size determination unit 10 to be passed on as the step size signal sw(k). For this purpose, the switch unit 14 is driven by a control signal s2.

Figure 4:
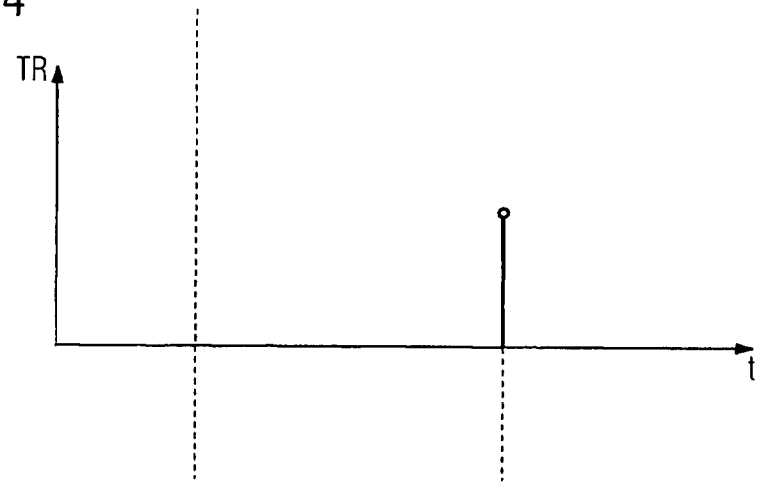
FIG. 4 shows a time diagram for the occurrence of a transient sound.
Figure 5:
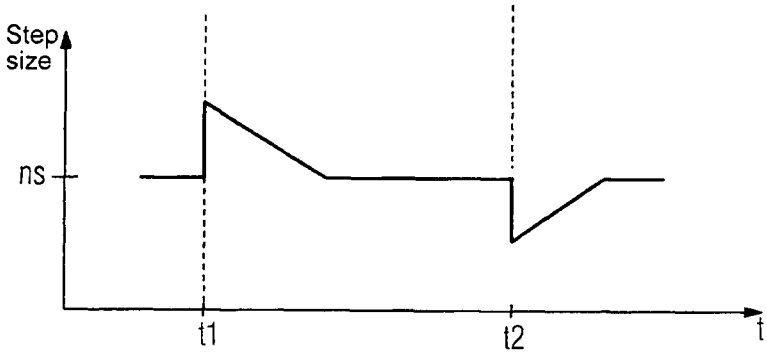
FIG. 5 shows a time diagram of the step width.

If now a transient sound event is perceived at time t2 as shown in FIG. 4, then the step size is reduced abruptly and subsequently increased gradually, as shown in FIG. 5. The reduction after time t1 and the increase of the step size after time t2 is favorably carried out within 0.5 to 1 second.

The principle of operation of the step size control circuit according to the invention can be summarized as follows:

a) Rapidly rising signals are detected in several frequency bands independently from one another and b) The number of frequency bands, in which these rising signals have been detected, is determined.

If a rapidly rising signal edge is detected in only one or at the most two frequency bands, it is concluded that an acoustic feedback is present. In the other case, when rapidly rising signal edges are detected in more than two frequency bands, a decision is made in favor of the presence of a transient signal (e.g. clinking of glass). In the case of feedback, the step size is subsequently briefly increased and returned to an average value ns within 0.5 to 1 second. In the case of the transient signal, a brief reduction in the step size takes place, as the signal is removed after a short time.

Because the step size is increased in the case of feedback as well as being reduced for transient signals, to which the adaptation responds particularly sensitively, it is possible to choose an average standard step size with which no artifacts occur in the case of normal signals such as music, and, in spite of this, the compensator can still be adapted to long-term changes in the feedback path. The controller can also be combined with a frequently implemented two-stage selection of the step size.

In an advantageous manner, several characteristics of feedback signals and naturally occurring signals are utilized in combination for controlling an adaptive filter by means of the step size controller according to the invention. Use is especially made of the fact that feedback signals usually occur very rapidly and have narrow bandwidth, while natural signals are extremely rarely monofrequent, as at the least they exhibit harmonics (music).

The invention claimed is:

1. A device for controlling a step size of an adaptive filter for suppressing an acoustic feedback, comprising:

an analyzing unit that analyzes an input signal in a plurality of frequency bands and detects steep signal edges in an individual frequency band of the plurality of frequency bands having rates of rise exceeding a predetermined rate in the individual frequency band; and a control unit connected to the analyzing unit that controls the step size of the adaptive filter based on a number of frequency bands in which the steep signal edges are detected, wherein the step size of the adaptive filter is increased by the control unit if the steep signal edges are detected in a maximum of two frequency bands indicating a presence of the acoustic feedback, wherein the step size of the adaptive filter is reduced by the control unit if the steep signal edges are detected in more than two frequency bands indicating a presence of a transient signal, and wherein the predetermined rate is a standard step size of the individual frequency band.

2. The device as claimed in claim 1, wherein the step size is increased quickly compared with a subsequent decreasing.

3. The device as claimed in claim 2, wherein the subsequent decreasing of the step size is within 0.5 to 1 second.

4. The device as claimed in claim 3, wherein the step size is decreased to a predetermined average value.

5. The device as claimed in claim 1, wherein the step size is reduced quickly compared with a subsequent increasing.

6. The device as claimed in claim 5, wherein the subsequent increasing of the step size is within 0.5 to 1 second.

7. The device as claimed in claim 1, wherein the adaptive filter is adapted with the increased step size or the decreased step size and the control unit accordingly produces a binary control signal.

8. The device as claimed in claim 1, wherein the device is used in a hearing aid device.

9. A hearing device with an adaptive filter, comprising:

an analyzing unit that analyzes an input signal in a plurality of frequency bands and detects steep signal edges in an individual frequency band of the plurality of frequency bands having a rate of rise exceeding a predetermined rate in the individual frequency band; and a control unit connected to the analyzing unit that controls a step size of the adaptive filter based on a number of frequency bands in which the steep signal edges are detected, wherein the step size is increased if the steep signal edges are detected in a maximum of two frequency bands, wherein the step size is reduced if the steep signal edges are detected in more than two frequency bands, and wherein the predetermined rate is a standard step size of the individual frequency band.

10. The hearing device as claimed in claim 9, wherein the hearing device is a hearing aid device.

11. A method for controlling a step size of an adaptive filter for suppressing an acoustic feedback of a hearing device, comprising:

analyzing an input signal in a plurality of frequency bands;

detecting steep signal edges in an individual frequency band of the plurality of frequency bands having a rate of rise exceeding a predetermined rate in the individual frequency band; and suppressing the acoustic feedback of the hearing device by controlling the step size of the adaptive filter based on a number of frequency bands in which the steep signal edges are detected, wherein the step size is increased if the steep signal edges are detected in a maximum of two frequency bands, wherein the step size is reduced if the steep signal edges are detected in more than two frequency bands, and wherein the predetermined rate is a standard step size of the individual frequency band.

* * * * *